US007166254B2

(12) United States Patent
Ichikawa et al.

(10) Patent No.: US 7,166,254 B2
(45) Date of Patent: Jan. 23, 2007

(54) PROCESS FOR PRODUCING SINTERED ALUMINUM ALLOY

(75) Inventors: Jun-ichi Ichikawa, Matsudo (JP); Takashi Suzuki, Matsudo (JP); Hideo Shikata, Matsudo (JP); Hideo Urata, Wako (JP); Hayato Matsuda, Wako (JP)

(73) Assignees: Hitachi Powdered Metals Co., Ltd., Chiba (JP); Honda Giken Kogyo Kabushiki Kaisha, Tokyo (JP)

( * ) Notice: Subject to any disclaimer, the term of this patent is extended or adjusted under 35 U.S.C. 154(b) by 161 days.

(21) Appl. No.: 10/437,234

(22) Filed: May 14, 2003

(65) Prior Publication Data

US 2003/0215348 A1 Nov. 20, 2003

(30) Foreign Application Priority Data

May 14, 2002 (JP) ..... 2002-137943

(51) Int. Cl.
*C22C 1/04* (2006.01)

(52) U.S. Cl. ..... 419/23

(58) Field of Classification Search ..... 419/29, 419/46, 23

See application file for complete search history.

(56) References Cited

U.S. PATENT DOCUMENTS 4,177,069 A * 12/1979 Kobayashi et al. ..... 419/38
4,460,541 A * 7/1984 Singleton et al. ..... 419/42
4,938,810 A * 7/1990 Kiyota et al. ..... 148/437
5,545,487 A 8/1996 Ishijima et al.
6,468,468 B1 * 10/2002 Neubing et al. ..... 419/38

FOREIGN PATENT DOCUMENTS

EP 0436952 A1 * 7/1991
EP 0669404 A2 * 2/1995
JP 4-365832 A 12/1992
JP 7-197167 A 8/1995
JP 7-197168 A 8/1995

OTHER PUBLICATIONS

ASM Handbook, vol. 7, Powder Metallurgy, pp. 125-130, 741-748, 1984.* http://www.azom.com/details.asp?Article ID=1417; Azom.com Linking Science and Technology for Global Solutions; Tech Brief: "Particle Size- US Sieve Series and Tyler Mesh Size Equivalents."

* cited by examiner

*Primary Examiner*—Roy King
*Assistant Examiner*—Michael P. Alexander
(74) *Attorney, Agent, or Firm*—Birch, Stewart, Kolasch & Birch, LLP

(57) ABSTRACT

A process for producing a sintered aluminum alloy in which dispersion of tensile strength is small and elongation property and fatigue strength are improved. In this process comprising the steps of compacting powder mixture containing rapidly solidified Al—Si powder, Al powder and Cu powder or Cu alloy powder into a green compact; sintering the green compact with optional heat treatment, Al powder having a maximum particle size smaller than a specific range, an average particle size within a specific range and specific particle size distribution, is used.

4 Claims, No Drawings

PROCESS FOR PRODUCING SINTERED ALUMINUM ALLOY

BACKGROUND OF THE INVENTION (1) Field of the Invention

The present invention relates to a process for producing a sintered aluminum alloy. More particularly, the sintered aluminum alloy prepared according to the present invention is characterized in that it has properties of small weight, high strength and excellent wear resistance. Accordingly, it is suitable for use in the production of machine parts such as gearwheels, pulleys, compressor vanes, connecting rods, pistons and so forth.

(2) Description of Prior Art

In view of the economy in energy consumption and the improvement in mechanical efficiency, the trend to use light-weight machine parts is growing. In comparison with ordinary cast alloys, it is possible for the sintered aluminum alloy to make a high-Si alloy containing fine crystals of pro-eutectic Si, so that the sintered aluminum alloy is expected as a material having excellent specific strength and wear resistance.

Such sintered aluminum alloys are disclosed in Japanese Laid-Open Patent Publication Nos. H4-365832, H7-197168, and H7-197167 and U.S. Pat. No. 5,545,487. Any of these alloys contains a certain amount of Si and is improved in strength and wear resistance having a dapple grain structure. The dapple grain structure herein referred to has specific areal ratios of Al-solid solution phase and Al—Si alloy phase, in the latter of which pro-eutectic Si crystals of a certain particle size are dispersed.

Although the above-mentioned sintered aluminum alloys have high strength and high wear resistance, however, in recent years, the alloys having higher strength and smaller thickness are demanded. Furthermore, because the above-mentioned alloys have deviations of strengths, cast machine parts must be made thick to a certain extent. Still further, there is room for improvement in the elongation property and the fatigue strength of the sintered aluminum alloys, so that the sintered aluminum alloy is expected to be improved further.

BRIEF SUMMARY OF THE INVENTION

In view of the above-described circumstances, the object of the present invention is to provide a process for producing a sintered aluminum alloy having higher elongation property and higher fatigue strength by reducing the deviation of strength.

In order to solve the above-mentioned problems, inventors have carried out several investigations on the causes of the deviation of strength of conventional sintered aluminum alloys. As a result, the inventors have found out the following phenomena.

When sintering temperature is elevated to about 517 to 524° C., Cu powder or Cu alloy powder generates eutectic Al—Si—Cu liquid phase and it diffuses into Al—Si powder in the initial stage. This diffusion of Cu into the Al—Si powder proceeds quickly until the quantity of Cu gets to the limit of solid solution. The excess Cu over the limit of solid solution remains as it stands and, after that, with the elevation of temperature above 548° C., the diffusion of Cu into the Al powder proceeds quickly with the generation of eutectic Al—Cu liquid phase. This diffusion of Cu into Al powder in higher temperature zone proceeds more rapidly as compared with the foregoing diffusion into Al—Si powder.

In other words, the diffusion of Cu into Al—Si matrix at lower temperatures occurs more rapidly and the diffusion into Al matrix occurs later. Accordingly, depending on sintering conditions, the content of Cu in Al matrix is higher in the outer portion of original powder, while the content of Cu is lower in the central portion, so that the segregation of components occurs. The inventors have found out that this segregation causes the deviation of strength, which obstructs the improvement in the elongation property and the fatigue strength.

By extending the time length of sintering to diffuse Cu sufficiently, the segregation can be avoided. However, the elongation of sintering time is not advantageous because it increases production cost. In order to accelerate the diffusion of Cu, it is possible to raise the sintering temperature, by which the diffusion rate of Cu is increased and Cu is diffused rapidly and uniformly. However, this measure is not preferable either, because if the sintering temperature is raised to 560° C. or above, supersaturated Si solid solution precipitates and grows into coarse pro-eutectic Si crystals. This causes to occur the lowering of strength and wear resistance disadvantageously.

The inventors have found out a counter-measure to eliminate the segregation of Cu and to unify the content of Cu in order to reduce the deviation of strength, so that the particle size of only Al powder is reduced. If the Al powder is very fine particles, the distances from surfaces to center portions of particles are reduced and this makes uniform the concentration of Cu in Al phase without the necessity of raising the sintering temperature, because Cu can easily and rapidly be diffused into the center portions of powder particles.

In this case, if the Al—Si powder also become into finer powder, the particle size distribution of whole powder mixture is inclined toward the side of fine particles, so that the flowability of powder itself is impaired and the weight and density of products become deviant undesirably.

DETAILED DESCRIPTION OF THE INVENTION

In view of the above-described technical background, in the method comprising the steps of preparing a powder mixture of at least rapidly solidified Al—Si powder, Al powder and Cu powder or Cu alloy powder, compacting the powder mixture into a green compact of predetermined configuration, and sintering the green compact and, as occasion demands, further subjecting it to heat treatment, the method for producing a sintered aluminum alloy of the present invention is characterized in that the maximum particle size of the above Al powder is 100 μm or less and the average particle size of the Al powder is in the range of 45 to 75 μm. Furthermore, the particle size distribution of the Al powder is defined such that 45 μm or less: 10 to 30 percent by mass; 45 to 75 μm: 35 to 65 percent by mass; and 75 to 100 μm: 15 to 35 percent by mass.

If the maximum particle size of Al powder is 100 μm or less, it is effective in uniformity of Cu content in Al phase, meanwhile if the maximum particle size is larger than this level, the diffusion of Cu becomes deviant.

With the reduction of the particle size of Al powder, the effect of the size reduction is conspicuous. However, the increase of fine powder causes the lowering of flowability of the powder mixture. In addition, the bridging is caused to occur in the feeding of the powder into a mold, which causes the deviation of filling quantity and the lowering of compressibility. Therefore, the grinding to excess is not advantageous, so that the average particle size of fine powder is 45 μm or more.

It is preferable that all the Al powder particles are not larger than 100 μm. In order to obtain the powder having a particle size of 100 μm or less in industrial working, the classification by sieves or by air blowing can be employed. In the sieving method, particles having large aspect ratio can pass through screen meshes. While, in the air blowing method, a small quantity of the particles having a particle size larger than 100 μm are sometimes contaminated according to operation conditions However, even when several percents of such unavoidable powder particles of larger than 100 μm are contained, if the average particle size is less than 75 μm, most of the Al powder particles exist in the finer side in particle distribution and the effect of the uniformity in the content of Cu can be attained.

Therefore, if the particle size distribution of Al powder is in the ranges of 45 μm or less: 10 to 30 percent by mass; 45 to 75 μm: 35 to 65 percent by mass; and 75 μm or more: 15 to 35 percent by mass, it is effective in attaining the uniformity of Cu content in Al phase, and also the flowability, compacting property and moldability of the powder mixture.

The Al powder herein referred to in the present invention means the one which contains 99.5 percent by mass or more of Al and the balance of unavoidable impurities.

As described above, by diffusing Cu uniformly into the Al phase, low strength portion can be eliminated to reduce the deviation of strength. In addition, because weak portion can be obviated, the elongation property and fatigue strength are improved to a large extent.

In a second aspect of the process for producing the sintered aluminum alloy of the present invention, because the Cu or Cu alloy powder particles diffuse into Al phase and Al—Si phase with remaining pores at the original sites of Cu or Cu alloy powder particles, when coarse particles are used, they form coarse pores, which cause the lowering of strength. Therefore, it is preferable to use fine particles of Cu powder or fine Cu alloy powder. Moreover, the fine Cu powder or Cu alloy powder is also effective in uniform diffusion into the Al phase by increasing contact areas. However, the powder of excessively small size is not desirable because it causes the lowering of the yield of material and the segregation in the powder mixture. Owing to theses reasons, Cu powder or Cu alloy powder is preferable to have an average particle size of 10 to 35 μm and a maximum particle size of 75 μm or less, preferably less than 45 μm.

In a third aspect of the process for producing the sintered aluminum alloy of the present invention, it is more effective to add Mg powder or Mg alloy powder such as Al—Mg alloy powder to the powder mixture. When Mg is added singly, it accelerates the diffusion of Cu with generating eutectic liquid phase of Al—Cu—Mg rapidly at temperature near 550° C. Meanwhile, when Mg is added as Al—Mg alloy, the Al—Mg liquid phase is formed at about 460° C. and it permeates all through the green compact by capillary action to cover all surfaces of powder particles and it removes oxide films on the surfaces of aluminum powder particles. When the temperature is elevated further to about 514° C., it generates eutectic liquid phase of Al—Cu—Mg and it accelerates the diffusion of Cu.

In a forth aspect of the process for producing the sintered aluminum alloy, that is the best method in the present invention, in which the processes as specified in the foregoing first to third aspects are applied to the alloy that is disclosed in U.S. Pat. No. 5,545,487. That is, a powder mixture is prepared by mixing 20 to 80 parts by mass of Al—Si alloy powder containing 13 to 30 percent by mass of Si and 80 to 20 parts by mass of the above-mentioned Al powder. Then, powder of Cu-transition metal alloy containing 0.2 to 30 percent by mass of one or more transition metals selected from the group consisting of Ti, V, Cr, Mn, Fe, Co, Ni, Zr and Nb; and Mg powder or Al—Mg alloy powder containing 35 percent by mass or more of Mg are added to the above powder mixture. Furthermore, the total composition in terms of mass of the thus obtained powder mixture is 2.4 to 23.5% of Si; 2 to 5% of Cu; 0.2 to 1.5% of Mg; 0.01 to 1% of the above transition metals and the balance of aluminum and unavoidable impurities.

In the following, the components and their quantities of respective powder are described.

[Al—Si Alloy Powder]

The component Si is generally effective to reduce the coefficient of thermal expansion and to improve the wear resistance by producing the precipitation of hard pro-eutectic Si crystals. The component of Si is added in the form of Al—Si alloy powder. In order to form the precipitate of pro-eutectic Si crystals during the rapid solidification in the production of powder, it is necessary that the content of Si is 13 percent by mass or more in the Al—Si alloy. If the content of Si is more than 30 percent by mass, the melting point in the production of powder is too high, so that the content of Si in the Al—Si alloy is preferably in the range of 13 to 30 percent by mass. In the portions of Al—Si alloy powder after sintering, a part of Mg, Cu and transition metals, which will be described later, form solid solutions as the alloy of Al—Si system containing dispersed pro-eutectic Si crystals and it forms a part of the alloy phase of sintered alloy with dapple grain structure. The Al—Si alloy phase is relatively hard, so that it mainly contributes to the strength and wear resistance.

The content of Si in the whole composition is selected within the range that the mixture of Al solid solution phase and Al—Si alloy phase containing dispersed pre-eutectic Si crystals, can exhibits a dapple grain structure. For this purpose, a range of 2.4 to 23.5 percent by mass is suitable. If the quantity of Si in the whole composition is too small, the quantity of pro-eutectic Si crystals in the Al—Si alloy phase is too small or the portion of the Al solid solution phase is too large. In these cases, the wear resistance is not satisfactory because of the lack of pre-eutectic Si crystals which contributes to the wear resistance. On the other hand, if the quantity of Si is too excess, the quantity of hard pro-eutectic Si crystals is too large or the portion of the Al solid solution is too small, in which the strength and ductility are low. In such cases, the wear resistance is also low because the hard pro-eutectic Si crystals accelerate the wear of the material in sliding contact or the pro-eutectic Si crystals that are released and not buried in the matrix, impair the wear resistance by acting as an abrasive to accelerate the wear.

[Al Fine Powder]

After sintering, the above-mentioned Al fine powder forms Al solid solution phase, which is the other phase in the dapple grain structure. The Al solid solution phase is relatively soft, in which Si, Mg, Cu and transition metals are diffused in Al. This phase is effective for imparting to the alloy toughness and conformability with materials being in contact. Furthermore, if the Al—Si alloy phase containing the dispersion of pro-eutectic Si crystals is subjected to plastic deformation or the pro-eutectic Si crystals are released off by the sliding contact, they are buried into the alloy matrix to reduce scratching wear.

In the above-mentioned combination of Al—Si alloy powder and Al fine powder, if the ratios of them are 20 to 80 and 80 to 20 by mass, respectively, the wear resistance is good. If the ratio of Al—Si alloy powder is less than 20 or more than 80 by mass, the wear resistance is impaired extremely.

[Mg Powder or Al—Mg Alloy Powder]

The component of Mg is effective in the strengthening of matrix and in the improvement of wear resistance by precipitation hardening in aging treatment. Mg becomes a liquid phase during the sintering and therefore, it exists in the matrix in the form of solid solution, which is effective in the acceleration of sintering, in the strengthening of matrix with $Mg_2Si$ that is precipitated in aging treatment, and in the improvement in wear resistance. As a measure to add the Mg component, Mg powder or Al—Mg alloy powder containing 35 percent by mass or more of Mg is used. The reason for the use of the Al—Mg alloy powder is that the melting point of binary Al—Mg alloy containing 33 to 70 percent by mass of Mg is as low as about 460° C. In the case that pure Mg powder is added, the Mg concentration is reduced by the solid phase diffusion with Al matrix in the process of sintering to form a liquid phase. Meanwhile, when the Al—Mg alloy powder containing about 33 percent by mass of Mg is used, the Mg concentration is lowered by the diffusion into Al matrix as described above, which results in the rise of melting point and the liquid phase cannot be utilized effectively. It is, therefore, preferable that the concentration of Mg is 35 percent by mass or more.

If the quantity of Mg is less than 0.2 percent by mass in the whole composition, the effect of addition of Mg cannot be expected. On the other hand, even if the quantity of Mg is increased to a value more than 1.5 percent by mass, the effect of addition is not increased more than a certain level. Therefore, the quantity of addition of Mg is desirably in the range of 0.2 to 1.5 percent by mass, and is more desirably in the range of 0.3 to 0.7 percent by mass.

[Cu Powder or Cu Alloy Powder]

The component Cu is effective in the strengthening of Al alloy matrix and its effect can be improved by aging treatment. If Cu content is less than 2 percent by mass in the whole composition, any desirable improvement in strength cannot be expected. If the content of Cu exceeds 5 percent by mass, the toughness is impaired because much intermetallic compound mainly containing Cu is formed to precipitate in the vicinity of grain boundaries. The more preferable content of Cu is 3.5 to 4.5 percent by mass.

Although the component Cu can be added in the form of Cu powder, it is desirable to add it together with suitable quantities of transition metals (Ti, V, Cr, Mn, Fe, Co, Ni, Zr and/or Nb) to coexist. By this means, the intermetallic compounds with Cu can be extinguished by solution heat treatment and aging treatment.

In the above-described Cu content, if the quantity of the transition metal in the whole component is less than 0.01 percent by mass, none of its effect is produced. On the other hand, if the quantity of the transition metal exceeds 1 percent by mass, the intermetallic compound mainly containing the transition metal is produced, which results in the lowering the toughness. Therefore, the quantity of the transition metal must be in the range of 0.01 to 1 percent by mass, and more preferable range is 0.1 to 0.5 percent by mass. It is preferable that the transition metal is added in the form of the powder of Cu-transition metal alloy because it is hardly diffused in the form of a single substance. Although the melting point of Cu-transition metal alloy is high, the melting point is lowered to generate a liquid phase by the solid-phase diffusion of atoms of Al and Mg in the sintering. By estimating the quantity of Cu and transition metal that are required in the whole composition, the quantity of the transition metal in the Cu-transition metal alloy powder is considered to be 0.2 percent by mass or more. However, if the quantity of transition metal is more than 30 percent by mass, the melting point of the alloy becomes too high and any liquid phase is not produced in the sintering. Therefore, the quantity of transition metal added in the Cu-transition metal must be in the range of 0.2 to 30 percent by mass, and more preferable range is 0.2 to 10 percent by mass.

The sintered aluminum alloy obtained by the method of the present invention can be used as the form of sintered compact. In order to raise the density and improve the strength, it is possible to subject the sintered alloy products to other appropriate processes such as cold or hot extrusion, or plastic deformation of hot press forging or rolling. Furthermore, the conventionally employed solution heat treatment or aging treatment can be employed.

PREFERRED EMBODIMENTS

Al-20 Si alloy powder having a maximum particle size of 150 μm; Al powder having a maximum particle size, an average particle size and a particle size distribution as shown in Tables 1 and 2; Cu-4 Ni alloy powder having a maximum particle size and an average particle size as shown in the same Tables; and Al-50 Mg alloy powder having a maximum particle size of 75 μm were mixed together in the ratios indicated in Tables 1 and 2 to prepare powder mixtures, the compositions of which powder mixtures are shown in Table 3. The flowability of these powder mixtures was determined according to JIS Z-2502 (Metallic powders—Determination of flowability) and the results are shown in the following Table 4 together with other test data.

After the preparation of the mixed powders, they were introduced into metallic mold and were compacted under a pressure of 200 MPa to form green compacts in the size of 40ϕ×25 mm. The thus obtained green compacts were dewaxed by heating at 400° C. for 60 minutes, which was followed by sintering at 550° C. for 60 minutes. The sintered compacts were subjected to hot press forging at 450° C. (temperature of material) and they were subjected to JIS T7 overaging treatment. Ten test pieces were then prepared from each forged material according to JIS Z-2201 (Test pieces for tensile test for metallic materials) and they were subjected to 10 times of tensile tests. Thereby determining the values in tensile strength and elongation. The values of average, maximum, minimum and dispersions of tensile strength and elongation are indicated in Table 4, wherein "dispersion" means the difference between maximum value and minimum value.

Meanwhile, test samples were formed into the test pieces for Ono's rotary bending tester and they were subjected to the rotating bending and fatigue test (JIS Z-2274). The results of the tests are also shown in Table 4.

TABLE 1

| Powder Material | Composition and Particle Size | Sample No. 01 | 02 | 03 | 04 | 05 | 06 |
|---|---|---|---|---|---|---|---|
| Al-20 Si Powder | Composition % by mass | 56.50 | 56.50 | 56.50 | 56.50 | 56.50 | 56.50 |
| Al Powder | Composition % by mass | 39.37 | 39.37 | 39.37 | 39.37 | 39.37 | 39.37 |
| | Maximum Particle Size μm | 150 | 100 | 75 | 45 | 100 | 100 |
| | Average Particle Size μm | 120 | 75 | 50 | 25 | 80 | 50 |
| | Particle Size Distribution up to 45 μm | 0 | 0 | 0 | 100 | 0 | 25 |
| | 45 to 75 μm | 0 | 0 | 100 | 0 | 0 | 50 |
| | 75 to 100 μm | 0 | 100 | 0 | 0 | 100 | 25 |
| | 100 to 150 μm | 100 | 0 | 0 | 0 | 0 | 0 |
| Cu-4 Ni Powder | Composition % by mass | 3.13 | 3.13 | 3.13 | 3.13 | 3.13 | 3.13 |
| | Maximum Particle Size μm | 75 | 75 | 75 | 75 | 75 | 75 |
| | Average Particle Size μm | 30 | 30 | 30 | 30 | 30 | 30 |
| Al-50 Mg Powder | Composition: % by mass | 1.00 | 1.00 | 1.00 | 1.00 | 1.00 | 1.00 |

TABLE 2

| Powder Material | Composition and Particle Size | Sample No. 07 | 08 | 09 | 10 | 11 |
|---|---|---|---|---|---|---|
| Al-20 Si Powder | Composition % by mass | 56.50 | 56.50 | 56.50 | 56.50 | 56.50 |
| Al Powder | Composition % by mass | 39.37 | 39.37 | 39.37 | 39.37 | 40.37 |
| | Maximum Particle Size μm | 100 | 75 | 100 | 100 | 100 |
| | Average Particle Size μm | 50 | 45 | 60 | 60 | 60 |
| | Particle Size Distribution up to 45 μm | 25 | 50 | 25 | 25 | 25 |
| | 45 to 75 μm | 60 | 50 | 60 | 60 | 60 |
| | 75 to 100 μm | 15 | 0 | 15 | 15 | 15 |
| | 100 to 150 μm | 0 | 0 | 0 | 0 | 0 |
| Cn-4 Ni Powder | Composition % by mass | 3.13 | 3.13 | 3.13 | 3.13 | 3.13 |
| | Maximum Particle Size μm | 75 | 75 | 150 | 45 | 75 |
| | Average Particle Size μm | 30 | 30 | 60 | 20 | 30 |
| Al-50 Mg Powder | Composition: % by mass | 1.00 | 1.00 | 1.00 | 1.00 | 0.00 |

TABLE 3

| Sample No. | Whole Composition: Percent by mass Al | Si | Cu | Ni | Mg |
|---|---|---|---|---|---|
| 01 | Balance | 11.30 | 3.0 | 0.13 | 0.50 |
| 02 | Balance | 11.30 | 3.0 | 0.13 | 0.50 |
| 03 | Balance | 11.30 | 3.0 | 0.13 | 0.50 |
| 04 | Balance | 11.30 | 3.0 | 0.13 | 0.50 |
| 05 | Balance | 11.30 | 3.0 | 0.13 | 0.50 |
| 06 | Balance | 11.30 | 3.0 | 0.13 | 0.50 |
| 07 | Balance | 11.30 | 3.0 | 0.13 | 0.50 |

TABLE 3-continued

| Sample No. | Whole Composition: Percent by mass Al | Si | Cu | Ni | Mg |
|---|---|---|---|---|---|
| 08 | Balance | 11.30 | 3.0 | 0.13 | 0.50 |
| 09 | Balance | 11.30 | 3.0 | 0.13 | 0.50 |
| 10 | Balance | 11.30 | 3.0 | 0.13 | 0.50 |
| 11 | Balance | 11.30 | 3.0 | 0.13 | 0.00 |

TABLE 4

| Sample No. | Evaluation Item: Tensile Strength: MPa Average | Maximum | Minimum | Dispersion | Elongation: % Average | Maximum | Minimum | Dispersion | Fatigue Strength MPa | Flowability sec |
|---|---|---|---|---|---|---|---|---|---|---|
| 01 | 356 | 360 | 320 | 40 | 2.50 | 2.70 | 2.00 | 0.70 | 161 | 4.2 |
| 02 | 363 | 368 | 340 | 28 | 3.50 | 3.60 | 3.20 | 0.40 | 168 | 4.4 |
| 03 | 358 | 370 | 350 | 20 | 4.07 | 4.10 | 3.80 | 0.30 | 171 | 4.4 |
| 04 | 364 | 370 | 345 | 25 | 4.95 | 5.30 | 4.50 | 0.80 | 171 | Non flow |
| 05 | 355 | 360 | 325 | 35 | 2.80 | 3.20 | 2.30 | 0.90 | 166 | 4.4 |
| 06 | 358 | 365 | 340 | 25 | 4.00 | 4.50 | 3.20 | 1.30 | 171 | 4.4 |

TABLE 4-continued

| Sample No. | Evaluation Item: Tensile Strength: MPa Average | Maximum | Minimum | Dispersion | Elongation: % Average | Maximum | Minimum | Dispersion | Fatigue Strength MPa | Flowability sec |
|---|---|---|---|---|---|---|---|---|---|---|
| 07 | 358 | 368 | 345 | 23 | 4.25 | 4.50 | 3.50 | 1.00 | 171 | 4.4 |
| 08 | 356 | 368 | 348 | 20 | 4.60 | 4.70 | 3.90 | 0.80 | — | 4.4 |
| 09 | 340 | 350 | 310 | 40 | 3.30 | 2.70 | 1.60 | 1.10 | 156 | 4.4 |
| 10 | 356 | 360 | 340 | 20 | 4.20 | 4.30 | 3.60 | 0.70 | 171 | 4.4 |
| 11 | 285 | 295 | 268 | 27 | 5.80 | 5.90 | 5.00 | 0.90 | — | 4.4 |

When the results of evaluation in Table 4 concerning the sample Nos. 01 to 04 in Tables 1 and 3 are compared, it is understood that, although the values of tensile strengths themselves are almost the same, the dispersion in tensile strength is large and the elongation and fatigue strength are low in sample No. 01 of a conventional example containing Al powder of 150 μm in the maximum particle size. Meanwhile, sample Nos. 02 to 04 containing Al powder of 100 μm or less in maximum particle sizes have small dispersions in tensile strength and improved in elongation and fatigue strength. However, it is noted that sample No. 04 containing Al powder of 45 μm or less in average particle size can hardly flow because the powder mixture exhibited no flowability.

When the evaluation results on sample Nos. 02 and 05 to 08 in Tables 1 and 2 are compared, even when the maximum particle size of Al powder is 100 μm or less (sample No. 08), it is understood that the smaller the average particle size of Al powder, the smaller the dispersion in tensile strength and the larger the elongation. In sample Nos. 02 and 06 to 08 of 75 μm in average particle sizes, the dispersions in tensile strengths are reduced by 70% or more and the elongations are improved by 140% or more as compared with those values in the conventional example of sample No. 01.

In view of the above observation, the effect was confirmed that, when the maximum particle size of Al powder is not more than 100 μm, the dispersion in tensile strength is small and the elongation and fatigue strength are improved. Furthermore, it was confirmed that, when the average particle size is in the range of 45 to 75 μm, the above effect can be enhanced while satisfying the flowability.

When the results of evaluation indicated in Table 4 on sample Nos. 07, 09 and 10 in Table 2 and 3 are compared, it is understood that sample No. 09 containing Cu alloy powder of 150 μm in maximum particle size has a low tensile strength but its dispersion is large, and the values of elongation and fatigue strength are particularly low. On the other hand, in sample Nos. 07 and 10 containing Cu alloy powder 75 μm or less in maximum particle size, the lowering of tensile strength is not observed and the dispersion of tensile strength is stably small. In addition, it is observed that the elongation and fatigue strength are particularly improved.

In sample No. 09 containing Cu alloy powder of 150 μm in maximum particle size, it is supposed that the diffusion of Cu was not completed during the sintering time in this case and a part of Cu remained as Cu—Al alloy, so that the dispersion of tensile strength became large and the elongation and fatigue strength are lowered. On the other hand, it is considered that, because the maximum particle sizes of Cu alloy powder were 75 μm or less in sample Nos. 07 and 10, the diffusion of Cu was completed during the sintering and Cu was uniformly dispersed, so that the dispersion of tensile strength was reduced and the elongation and fatigue strength were improved.

When the results of evaluation on sample Nos. 07 and 11 in Tables 2 and 3 are compared, it is understood that sample No. 07 containing Mg has larger tensile strength while elongation is smaller.

According to the above-described results, it was confirmed that the Cu alloy powder is preferably fine, and when its maximum particle size is 75 μm or less, the dispersion of tensile strength is small and the elongation and fatigue strength are improved. Furthermore, when Mg is contained, although the tensile strength is improved, the elongation is reduced, so that the use of Mg may be selected appropriately in view of uses.

In accordance with the process for producing the sintered aluminum alloy in the present invention, the dispersion of tensile strength can be reduced and the elongation and fatigue strength can be improved. Therefore, it is possible to produce various machine parts having excellent characteristics such as high strength, light weight and small thickness.

What is claimed is:

1. A process for producing a sintered aluminum alloy comprising the steps of preparing a powder mixture of at least rapidly solidified Al-Si powder, Al powder and Cu powder or Cu alloy powder; compacting said powder mixture into a green compact of predetermined configuration; and sintering said green compact and, if necessary, further subjecting it to heat treatment, wherein the maximum particle size of said Al powder is 100 μm or less and the average particle size of said Al powder is in the range of 45 to 75 μm and the particle size distribution of said Al powder is:

45 μm or less: 10 to 30 percent by mass, 45 to 75 μm: 35 to 65 percent by mass, and 75 μm or more: 15 to 35 percent by mass.

2. The process for producing a the sintered aluminum alloy in claim 1, wherein the maximum particle size of said Cu powder or Cu alloy powder is not larger than 75 μm and the average particle size is in the range of 10 to 35 , μm.

3. The process for producing a the sintered aluminum alloy in claim 1, wherein said powder mixture contains Mg powder or Mg alloy powder.

4. The process for producing a the sintered aluminum alloy of claim 1, wherein said powder mixture is prepared by mixing:

20 to 80 parts by mass of rapidly solidified Al—Si powder containing 13 to 30 percent by mass of Si;

80 to 20 parts by mass of said Al powder;

Cu-transition metal alloy powder containing 0.2 to 30 percent by mass of one or more transition metals selected from the group consisting of Ti, V, Cr, Mn, Fe, Co, Ni, Zr and Nb; and Mg powder or Al-Mg alloy powder containing 35 percent by mass of Mg;

and the contents in the whole composition of said powder mixture are: 2.4 to 23.5 percent by mass of Si, 2 to 5 percent by mass of Cu, 0.2 to 1.5 percent by mass of Mg, 0.01 to 1 percent by mass of said transition metals, and the balance of aluminum plus unavoidable impurities.

* * * * *